United States Patent [19]

Wallstein

[11] Patent Number: 4,513,814

[45] Date of Patent: Apr. 30, 1985

[54] GLASS PIPE HEAT EXCHANGER

[75] Inventor: Dieter Wallstein, Bochum, Fed. Rep. of Germany

[73] Assignee: Langbein & Engelbracht GmbH & Co. KG, Bochum, Fed. Rep. of Germany

[21] Appl. No.: 436,964

[22] Filed: Oct. 27, 1982

[30] Foreign Application Priority Data

Oct. 27, 1981 [DE] Fed. Rep. of Germany ..... 3142485

[51] Int. Cl.[3] ..... F28D 7/00; F28F 9/22; F28F 19/00

[52] U.S. Cl. ..... 165/134 R; 165/160; 165/134 DP; 165/DIG. 8; 165/DIG. 18; 165/168; 165/47

[58] Field of Search .... 165/134 R, 134 DP, DIG. 18, 165/DIG. 8, 160, 178, 47, 162, 168, DIG. 28, 165/DIG. 12;237/55

[56] References Cited

U.S. PATENT DOCUMENTS

| | | | |
|---|---|---|---|
| 1,500,456 | 7/1924 | Junkers | 165/168 |
| 1,739,576 | 12/1929 | Burke | 165/134 R |
| 1,941,365 | 12/1933 | Patterson et al. | 165/134 DP |
| 2,181,597 | 11/1939 | Cross | 165/134 R |
| 3,749,160 | 7/1973 | Vestre | 165/160 |
| 4,079,702 | 3/1978 | Furukawa et al. | 165/134 R |

FOREIGN PATENT DOCUMENTS

| | | | |
|---|---|---|---|
| 268833 | 1/1928 | Fed. Rep. of Germany | 165/134 R |
| 158746 | 12/1979 | Japan | 165/134 R |
| 1552201 | 9/1979 | United Kingdom . | |
| 1577202 | 10/1980 | United Kingdom . | |

*Primary Examiner*—William R. Cline
*Assistant Examiner*—John K. Ford
*Attorney, Agent, or Firm*—Michael J. Striker

[57] ABSTRACT

A heat exchanger particularly for cooling of hot smoke gases with aggresive components by clean gas to be heated, has side walls having two spaced ends, bottom walls arranged at the ends of the side walls, a plurality of glass pipes extending substantially parallel to each other and to the side walls and arranged so that a smoke gas passes through the glass pipes, while a clean gas passes transversely to the latter, and flow passages extending along the side walls in direction of glass pipes and arranged for guiding the smoke gas.

7 Claims, 3 Drawing Figures

GLASS PIPE HEAT EXCHANGER

BACKGROUND OF THE INVENTION

The present invention relates to a glass pipe heat exchanger, particularly for cooling of hot smoke gases with aggressive components.

Heat exchangers of the above-mentioned general type are known in the art. The glass pipe heat exchangers with pipe bottoms and side walls of high corrosion-resistant steels, for example CrNi-steel with extremely high nickel content, are used in particular where smoke gas with extremely aggressive components must be cooled, whose chemical composition cannot be exactly determined in advance. The main field of application is garbage incinerating devices. They are also used for elimination of waste from the automobile industry. In both cases the chemical composition of the generated hot smoke gases are not known because of the constantly changing mixture of the materials to be burnt. The above-described glass pipe heat exchanger is charged with hot smoke gas through the glass pipes and guided at the exit via a washer with a subsequent droplet separator, whereas the glass pipes are loaded between the side walls and the bottom walls with cold clean gas. The clean gas which is thereby heated in the heat exchanger is finally supplied to the fire place. It has been noticed that despite all measures taken with respect to the gas passage and with respect to the material for the pipe bottoms and side walls, the side walls of the heat exchanger are subjected to corrosion after a relatively short operation time.

The cause of this is exceeding of the dew point in the region of the side walls, inasmuch as the side walls encounter exclusively the clean gas which is considerably cooler than the smoke gas. As a result, the aggressive components in gas come into their full action.

SUMMARY OF THE INVENTION

Accordingly, it is an object of the present invention to provide a heat exchanger which avoids the disadvantages of the prior art.

More particularly, it is an object of the present invention to provide a glass pipe heat exchanger which eliminates corrosion damage to its side walls over a longer operational time, as compared with the known heat exchangers.

In keeping these objects and with others, which will become apparent therein after, one feature of the present invention recites, briefly stated, in a glass pipe heat exchanger having side and bottom walls and a plurality of glass pipes arranged so that a smoke gas passes through the glass pipes while a clean gas passes transverse to the latter, wherein means are provided for forming flow passages which extend along the side walls in direction of the glass pipes and are arranged for guiding the smoke gas.

When the heat exchanger is designed in accordance to the present invention, the flow passages which extend along the side walls in direction of the glass pipes are now also charged with hot smoke gas.

A portion of the smoke gas to flow through the glass pipes is preliminarily branched off and supplied through the flow passages. In this case the temperature level at the side walls can be retained so high that at no location does the excess of the mentioned dew-point take place and the corrosion damage is effectively prevented. Because of the inventive features, the temperature level at the side walls is guaranteed automatically by the hot smoke gas and thereby the heat exchanger is provided with a quasi integrated side wall heating without foreign energy.

Although it is possible that along both side walls which are insulated from the surrounding atmosphere several flow passages can be provided one near the other, an advantageous embodiment of the invention resides in a construction in which the flow passages extend over the entire width of the side walls. In this case they can be subdivided by establishing inserts whose cross sections are selected so that they do not form noticeable flow resistance.

In accordance with another feature of the invention, the flow passages are separated from a space in which the clean gas extends transversely to the glass pipes and around the latter, by intermediate walls of high corrosion-resistant sheet material. These features are especially advantageous when the glass pipe heat exchanger already in use must be subsequently converted in accordance to this invention. In this case it suffices, for example, to remove only pipe rows immediately adjacent to the side walls and to introduce the intermediate walls. Both, the side walls and the intermediate walls are retained by the hot smoke gas at the required temperature level.

Finally, in accordance with a further advantageous feature of the present invention the inlet cross section of the flow passages is changeable. In a simple case, this can be accomplished by removal of the pipe bottom supporting the glass pipes in the region of the flow passages. By suitable formation of the supply openings, it can be taken care that the original ratio of the quantity of the smoke gas flowing through the glass pipes with consideration of the subsequent cooling, to the quantity of the clean gas flowing transversely of the heat exchanger is maintained.

The novel features which are considered characteristic of the invention are set forth in particular in the appended claims. The invention itself, however, as to the construction thereof and its method of operation, will be best understood from the following description of specific embodiments when read in connection with the accompanying drawings.

A DESCRIPTION OF A PREFERRED EMBODYMENT

Figure 1:
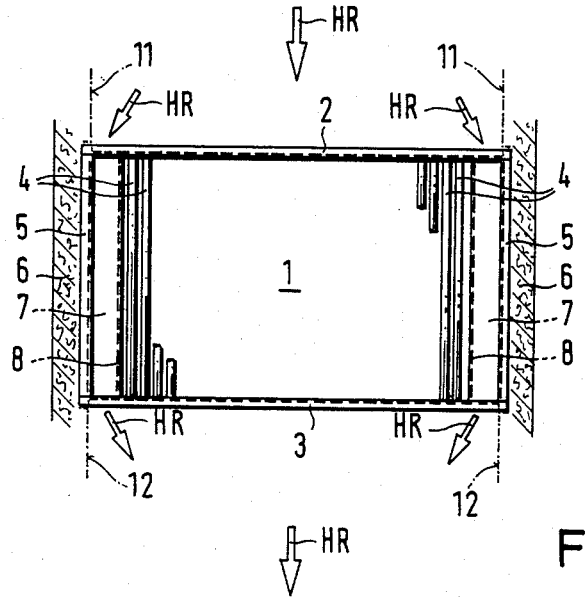
FIG. 1 is a side view schematically showing a glass pipe heat exchanger in accordance to the present invention.
Figure 2:
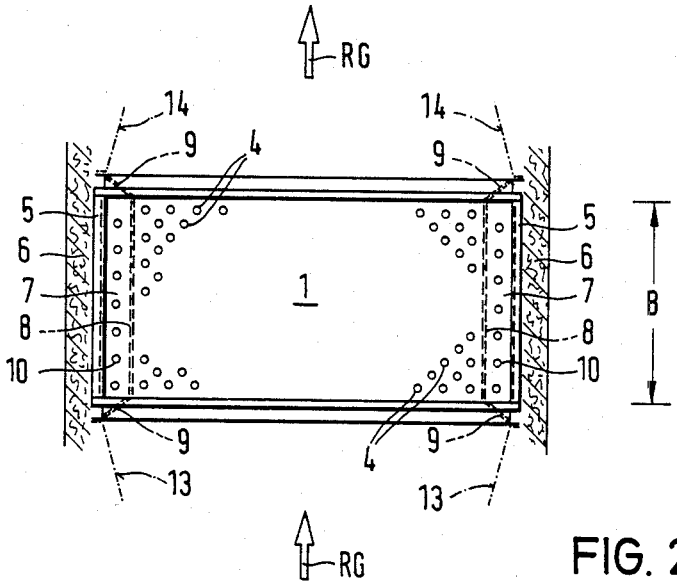
FIG. 2 is a plan view schematically showing the glass pipe heat exchanger of FIG. 1.

A glass pipe heat exchanger in accordance to the present invention shown in FIGS. 1 and 2 is identified as a whole by reference numeral 1. The glass pipe heat exchanger 1 has an upper pipe bottom 2, a lower pipe bottom 3, and lateral walls 5 extending between the pipe walls 2 and 3.

A plurality of glass pipes 4 extend between the pipe bottoms 2 and 3 parallel to one another and are supported in the pipe bottoms. The side walls 5 are separated from the surrounding atmosphere by a heat insulation 6 composed, for example, of mineral wool. The pipe bottoms 2 and 3 and side walls 5 are composed of a high corrosion-resistant material, for example a CrNi-steel with an extremely high nickel content. As can be seen from FIGS. 1 and 2 the heat exchanger 1 has passages 7 which extend along the side walls 5, and more particularly over the entire width B of the latter. The passages 7 extend in the direction of the glass pipes 4. They are limited by the side walls 5 of the glass pipe heat exchanger 1, on the one hand, and by intermediate walls 8 composed of CrNi-steel with extremely high nickel content, on the other hand.

The end sides of the passages 7 are closed by inclined sheets 9 of the same material. The inclined position serves for improved flow guidance. In connection with this, it can be seen particularly from FIG. 1 that the glass pipes 4 in the passages 7 are removed. The passages 7 are substantially unobstructed passages without inserts in them. When it is necessary to provide elements for supporting the intermediate walls 8 relative to the side walls 5, these elements can be arranged in the longitudinal direction of the glass pipes 4 and provided with a cross section which does not affect the gas flow in the passages 7.

The heat exchanger 1 in accordance to the present invention, as shown in FIGS. 1 and 2, operates in the following manner:

As indicated in FIG. 1, the hot smoke gas HR flows, for example, from above into a passage 11 of the glass pipe heat exchanger 1 and enter the glass pipes 4 which are offset from one another by gaps therebetween, on the one hand, and also enters via perforations 10 in the upper pipe bottom 2 shown in FIG. 2 the lateral flow passages 7, on the other hand. The smoke gas HR has at the entrance in the glass pipes 4 and the flow passages 7 a temperature, for example, equal to 300° C.

After leaving the glass pipe heat exchanger 1, the smoke gas HR cooled now to a temperature approximately 220° C. is supplied via a discharge passage 12 to (not shown) a washer with a subsequent droplet separator where it is cooled to approximately 70° C.

The thus cooled clean gas RG is supplied, as can be seen from FIG. 2, via a passage 13 to the glass pipe heat exchanger 1 and flows between the upper and lower pipe bottoms 2 and 3 and the intermediate walls 8 around the glass pipes 4 to thereby cool the smoke gas HR inside the glass pipes 4. The clean gas RG is at the same time heated to a temperature of approximately 105°–110° C. and discharged via a discharge passage 14 to a (not shown) fire place.

Figure 3:
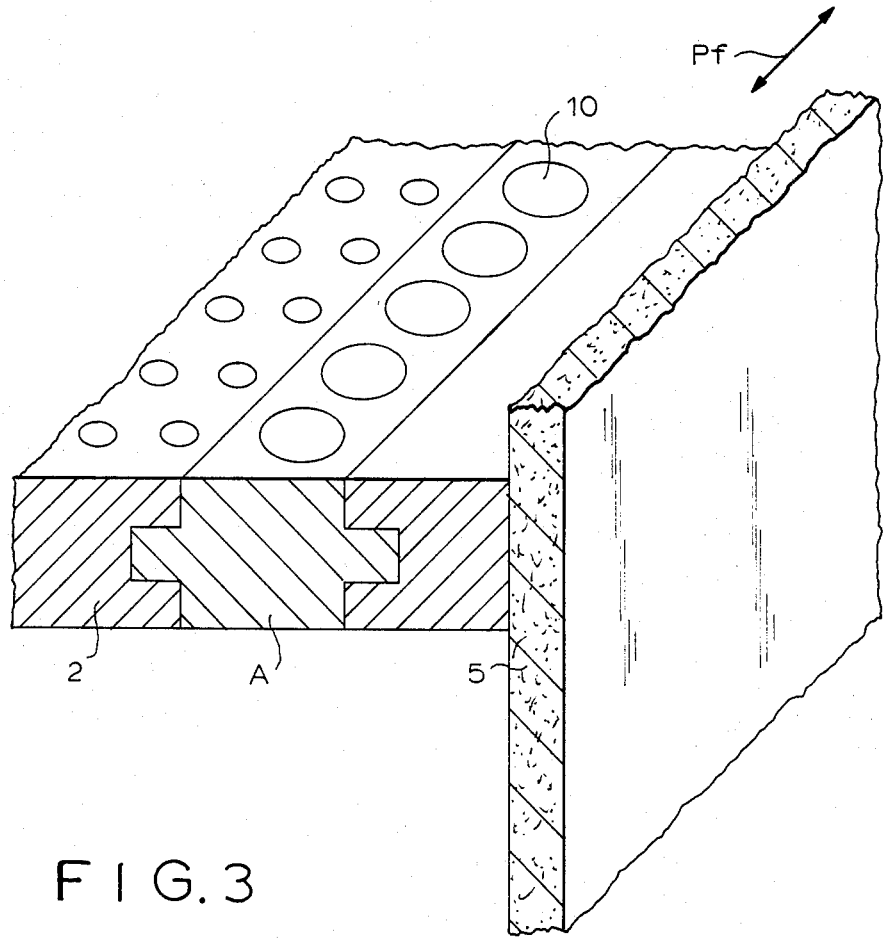
FIG. 3 is a perspective view showing a portion of an upper bottom of the inventive glass pipe heat exchanger.

FIG. 3 shows that the inlet cross section of the lateral flow passages 7 can be adjusted by exchanging of strips A having perforations 10 of differing dimensions. The strips A are displaceable in direction of the arrow Pf.

It will be understood that each of the elements described above, or two or more together, may also find a useful application in other types of environments differing from the types described above.

While the invention has been illustrated and described as embodied in a glass pipe heat exchanger, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims.

I claim:

1. A heat exchanger, particularly for cooling of hot smoke gases with aggressive components by clean gases to be heated, the heat exchanger comprising elongated side walls each having two spaced ends;

bottom walls each arranged at a respective one of said ends of said side walls;

a plurality of glass pipes extending substantially parallel to each other and to said side walls and arranged so that a hot smoke gas passes through said glass pipes in a first direction, while a cold clean gas passes in a second direction transversely to passage of said hot smoke gas; and means forming flow passages for said hot smoke gases extending along said side walls in said first direction in said cold clean gas passage and preventing contact of said side walls only with said cold clean gas.

2. A heat exchanger as defined in claim 1, wherein said side walls and said bottom walls are composed of a high corrosion-resistant sheet material.

3. A heat exchanger as defined in claim 1, wherein said side walls have a predetermined width, said flow passages extending over a distance corresponding to the entire width of said side walls.

4. A heat exchanger as defined in claim 1, wherein the clean gas flows around said glass pipes in a space surrounding the latter, said means including intermediate walls separating said flow passages from said space.

5. A heat exchanger as defined in claim 4, wherein said intermediate walls are composed of a high corrosion-resistant sheet material.

6. A heat exchanger as defined in claim 1; and further comprising means for changing an inlet cross section of said flow passages and including a plurality of elements which form inlets of different cross sections.

7. A heat exchanger as defined in claim 6, wherein said elements are exchangeably mountable in one of said bottom walls.

* * * * *